United States Patent [19]

Okada et al.

[11] Patent Number: 4,499,639

[45] Date of Patent: Feb. 19, 1985

[54] PROCESS FOR BROADENING THE WIDTH OF A BUNDLE OF PARALLEL FILAMENTS HAVING A BAND FORM

[75] Inventors: Tokio Okada; Haruhisa Tani; Shigezo Kojima; Setsuya Tsuyama; Kazuhiko Kurihara; Hiroshi Yazawa, all of Tokyo, Japan

[73] Assignee: Polymer Processing Research Institute Ltd., Tokyo, Japan

[21] Appl. No.: 372,132

[22] Filed: Apr. 27, 1982

[30] Foreign Application Priority Data

May 1, 1981 [JP] Japan ..... 56-66491

[51] Int. Cl.[3] ..... D01D 11/02; D02J 1/18

[52] U.S. Cl. ..... 28/282

[58] Field of Search ..... 28/103, 282; 26/87; 264/280, DIG. 47

[56] References Cited

U.S. PATENT DOCUMENTS

| | | | |
|---|---|---|---|
| 3,345,242 | 10/1967 | Rasmussen | 264/DIG. 47 |
| 3,350,491 | 10/1967 | Rasmussen | 26/87 X |
| 3,369,276 | 2/1968 | Kalwaites | 28/103 X |
| 3,461,508 | 8/1969 | Cole | 28/282 |
| 4,106,166 | 8/1978 | Henning | 28/103 |

FOREIGN PATENT DOCUMENTS

| | | | |
|---|---|---|---|
| 47-20471 | 9/1972 | Japan | 28/282 |
| 50-15884 | 6/1975 | Japan | 28/282 |
| 694789 | 7/1953 | United Kingdom | 28/282 |

*Primary Examiner*—Robert R. Mackey
*Attorney, Agent, or Firm*—Fred Philpitt

[57] ABSTRACT

A process for broadening the width of a bundle of parallel filaments having a band form is provided, which comprises, during the running course of the bundle in the lengthwise direction, holding the bundle under press by a direction-turning bar or bars arranged obliquely to the advancing direction of the bundle along its surface; while preventing the bundle approaching the resulting oblique holding line from varying in its approach angle and also shifting to its widthwise direction, turning the direction of the bundle leaving the bar or bars to a direction having an optional angle against the oblique holding line; and taking up the resulting bundle having a required width.

2 Claims, 2 Drawing Figures

PROCESS FOR BROADENING THE WIDTH OF A BUNDLE OF PARALLEL FILAMENTS HAVING A BAND FORM

BACKGROUND OF THE INVENTION

1. Field of the Invention

This invention relates to a process for broadening the width of a bundle of parallel filaments having a band form and thereby preparing a thinner layer therefrom, which process comprises pinching the bundle along a direction-turning bar or bars arranged obliquely to the approaching direction of the bundle to the straight bar(s) along the surfaces thereof and turning the advancing direction of the bundle to an optional direction according to the required broadened width for the bundle.

The bundle of parallel filaments having a band form referred to herein means an untwisted bundle of parallel filaments such as tow, rovings, strands or the like of organic or inorganic filaments, arranged in parallel in the form of a band having a flat long rectangle in the cross-section.

The bundle of parallel filaments having a band form will often be hereinafter abbreviated merely to "bundle".

2. Description of the Prior Art

As to fabrics used for reinforcing industrial materials, etc., it has generally been regarded as most important that the fabrics are cheap and have sufficient strengths and uniformity; if a thin layer of parallel filaments having a uniform thickness is available, a reinforced material having an optional tenacity can be manufactured at a low cost by laminating the material as wefts and/or warps, and conventional woven or non-woven fabrics using expensive yarns obtained via a number of steps such as spinning, twisting, etc. will be replaced by the above laminated fabrics.

A prior art has been proposed wherein the width of a tow of crimped filaments is broadened by an arculate guide, utilizing the property that its filaments are internally connected in order, embracing each other by their crimps in the lateral direction, and the product is used as waddings or non-woven fabrics. However, according to the technique of this kind, a thin layer of 50 g/m$^2$ or less is difficult to prepare and it is entirely difficult to broaden the width of uncrimped tow, rovings, strands, etc. having no connection in the lateral direction.

If a bundle of parallel filaments having a band form is laid straightly on a flat surface, and a straight bar is placed on the bundle obliquely to the lengthwise direction so that the filaments under the bar may be pinched and one end of the bundle is pulled up so that all the filaments may be directed to the same direction as that of pulling-up, then the width of the pulled-up bundle is varied according to the direction of pulling-up and the maximum width is obtained when the direction of pulling-up is perpendicular to the bar. Making use of this principle, the width of the bundle can be broadened. However, according to conventional prior art, it has been difficult to continuously carry out the above steps during the running course of the bundle. Namely, such a bundle is generally led by rotating rolls. In this case, the layer is sent toward their rotating direction along with the rotation of the roll surfaces; hence it always tends to approach the rolls in a direction perpendicular to the axial lines of the rolls. Thus it is impossible for usual pinch rolls to hold such a bundle pinching it obliquely to its advancing direction. Further, British Pat. No. 1,078,732 discloses a process wherein a film or a band is obliquely pinched by a pair of nip rolls. These rolls are specifically designed in order to prevent the film or band from sliding along the nip towards that side of the nip at the time of turning the direction of the film or band by the nip. Each of the nip rolls has a core and has its surface divided along generatices into at least two segments, each segment extending substantially along the length of the surface and being mounted to reciprocate along the core and to rotate with the core. According to the process, however, the structure of the device is so complicated that it is difficult to carry out the practice. Thus the process is not practical. No process utilizing simple stationary bar(s) has been found till now for holding a running bundle of parallel filaments by pinching it obliquely to its advancing direction.

SUMMARY OF THE INVENTION

The present invention provides a new process for broadening the width of a bundle of parallel filaments having a band form, whether crimped or uncrimped, maintaining the uniformity of the density of the filaments in their lateral direction, to thereby prepare a uniform thinner layer of the parallel filaments.

The present invention has a main aspect (1) as follows:

A process for broadening the width of a bundle of parallel filaments having a band form, which process comprises:

during the running course of said bundle in the lengthwise direction, holding said bundle under press along a direction-turning bar or bars arranged obliquely to the advancing direction of said bundle, along its flat surfaces;

while preventing said bundle approaching the holding line formed along said direction-turning bar or bars, from varying in its approach angle and also shifting to its widthwise direction, turning the advancing direction of said bundle having left the holding line to a direction of an optional angle against the holding line; and taking up the resulting bundle having a required width.

The present invention has the following two aspects:

(2) A process according to the above main aspect (1), which comprises:

leading said bundle together with a belt moving in the lengthwise direction of said bundle, between two direction-turning bars arranged obliquely to the advancing direction of said bundle, and holding said bundle and said belt under press between said bars so that one of said bars may be contacted with said bundle and the other may be contacted with the back surface of said belt, to thereby form said holding line between the former bar contacted with said bundle and the surface of said belt;

while preventing said bundle approaching said holding line, from varying in its approach angle and also shifting to its widthwise direction, by the guiding action of said belt, turning the advancing direction of said bundle leaving said holding line to a direction of an optional angle against said holding line;

separating said bundle having left said bars from said belt; and taking up the resulting bundle having a required width.

(3) A process according to the above main aspect (1), which comprises:

placing said bundle between an upper belt and a lower belt moving in the lengthwise direction of said bundle in an overlapping manner;

holding said bundle under press between two direction-turning bars arranged obliquely to their advancing directions along their surfaces so that one of said bars may be contacted with the back surface of said upper belt and the other may be contacted with the back surface of said lower belt, to form said holding line between said two belts corresponding to said direction-turning bars;

while preventing said bundle approaching said holding line, from varying in its approach angle and also shifting to the widthwise direction thereof, by the guiding action of said belts, separating the overlapped belts leaving said holding line from each other by turning the advancing direction of at least one of said two belts, along the direction-turning bar contacting the belt; and taking up the resulting bundle having a required width.

According to the process of the present invention, even when the bundle having left the guides is taken up in an optional direction, the bundle is prevented from varying in the approach angle and also moving in the widthwise direction, because the influence of the direction-turning of the bundle is intercepted at the holding part. Thus it is possible to prepare a broadened thinner layer continuously and smoothly.

BRIEF DESCRIPTION OF THE DRAWINGS

FIG. 1 shows a plan view illustrating the relationship among belts, direction-turning bars obliquely installed and take-up pinch rolls.

FIG. 2 shows a side view of the above means as viewed from the axial direction of the direction-turning bars.

DETAILED DESCRIPTION OF THE INVENTION

Figure 1:
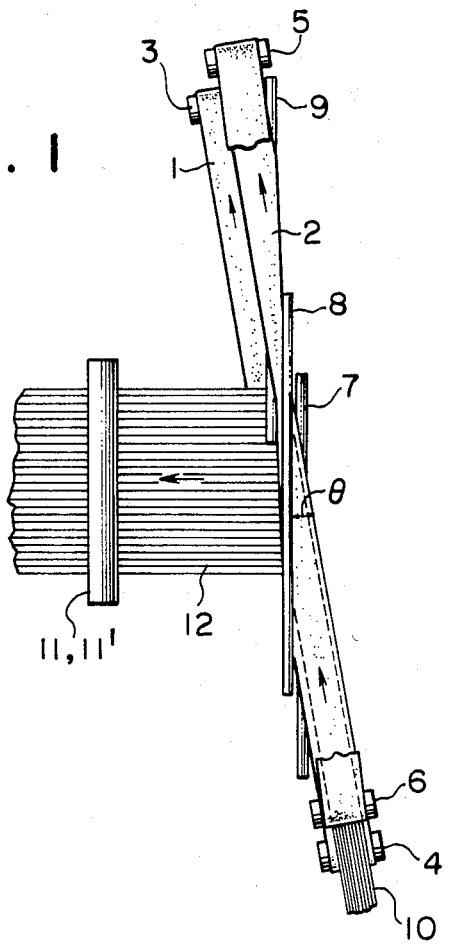
FIG. 1 and FIG. 2 illustrate an embodiment of the present invention.
Figure 2:
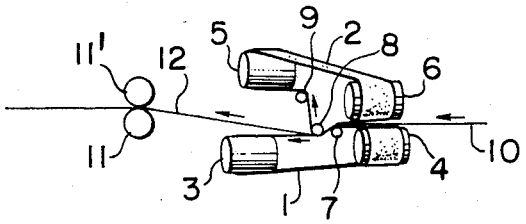

In order to make the understanding of the present invention easier, description will be first made referring to FIG. 1 and FIG. 2 illustrating an embodiment of the present invention described above.

In FIG. 1 and FIG. 2, two circulating belts, an upper one 2 and a lower one 1, advancing under tension, are circulated at the same velocity between pulleys 3 and 4 and between 5 and 6, respectively. Belts 1 and 2 having passed through pulleys 4 and 6 advance in an overlapping state with one another, and the respective surfaces of the belts are brought into close contact by direction-turning bars 7 and 8 installed obliquely to the advancing direction by an angle of $\theta$ along the surfaces of the bars, pressing the surfaces on each other, from both the upper side and the lower side. The lower belt 1, after having left the oblique bar 7, is straightly advanced and returned to pulley 4 via pulley 3, while the upper belt 2, after having left the oblique bar 8, is separated obliquely from the lower belt 1 along the surface of the direction-turning bar 8, and returned to pulley 6, via an oblique bar 9 arranged above the oblique bar 8 and via pulley 5. A bundle of parallel filaments 10 fed onto the belt 1 at the location of the pulley 4 advances along with the belt 1 and is held under press by the belts 1 and 2 from the upper and lower sides at the locations of the direction-turning bars 7 and 8, and the filaments held along the line corresponding to the bar do not shift relative to the belt surface. The belts 1 and 2 having passed through the oblique bar 8 are separated from each other and advance toward the respective directions, releasing the holding of the bundle. The holding of the bundle of the parallel filaments 10 is released on the straight line having an oblique angle of $\theta$ to the direction of the belts. The bundle is then drawn in the perpendicular direction to the oblique bar 8 by pinch rolls 11, 11' arranged in parallel to the oblique bar 8, whereby the width of the bundle 10 is extended to $1/\sin\theta$ times the original width to give a uniformly developed layer 12.

FIG. 1 and FIG. 2 show an embodiment of pinching the bundle 10 between the upper and lower belts, whereas, in the case of fibers having a small coefficient of friction and a high abrasion resistance, if the bundle placed on the lower belt is pressed directly by the tension of the lower belt between the direction-turning oblique bar and the belt, without using the upper belt, and the bundle is drawn in the perpendicular direction to the releasing straight line along the direction-turning bar, then the same effect as that in the above embodiment is obtained. The axial line of the pinch rolls 11, 11' are not always necessary to be in parallel to the oblique bars, but, in the case where the oblique angle $\theta$ of the bars is constant, the above arrangement of the pinch rolls 11, 11' in parallel to the oblique bar affords the highest width-broadening ratio.

As the direction-turning bar or bars referred to above in the main aspect of the present invention, straight-linear bars or tubes having a circular cross-section are usually employed, and fixed at definite locations along the surfaces of the bundle and obliquely to its advancing direction, so that these bars or tubes cannot be rotated. Usually their surfaces are treated so as to be durable to frictional wearing; and their abrasion is effectively prevented if they are rotated at a far slower peripheral velocity than the running velocity of the bundle or somewhat rotated so that the contact surface is varied occasionally.

The belts may be either one belt having a width corresponding to the width of the bundle introduced or a plurality of belts arranged in parallel and adjacent to each other, and if the tension of the belt is kept high enough, it is possible to hold the bundle under the necessary pressing force by the tension of the belts even when the direction-turning bar corresponding to numeral 7 in the drawings is not provided.

In the case where the surfaces of the direction-turning bars are subjected to an anti-abrasion treatment and have a small coefficient of friction, if the filaments are abrasion-resistant, the object of the process of this invention can be attained by introducing the bundle between the direction-turning bar and the belt and pressing them directly by the belt onto the surface of the bar, but it is generally more advantageous to introduce and press the bundle between an upper belt and a lower belt advancing in an overlapping state, because there is no fear of injuries of filaments, disturbance of their arrangement, etc. caused by friction between the filaments and the bar.

If the bundle has an original width of b and the direction-turning bars have an oblique angle of $\theta$ to the approaching direction of the bundle and the belts, the length l of the holding line of the bundle held under press along the direction-turning bar is equal to b/sin $\theta$, and if the bundle is turned and drawn in a perpendicular direction to the bar, the resulting parallel width b is equal to l which is the maximum value of the width when the oblique angle is kept at $\theta$.

The bundle uniformly broadened in the width and made thinner according to the process of the present invention can be wound up in the form of a non-woven fabric obtained by fixing the filaments therebetween with a small amount of a sizing agent, or can be wound up in the form of a non-woven fabric consisting of laminated warp and weft, obtained according to a separate invention of the applicant disclosed in U.S. Pat. No. 4,052,243 (1977), entitled "Improved method for producing a cross-laminated cloth-like product from wide warp and weft webs".

EXAMPLE 1

A polyacrylonitrile filament tow of 100,000 d passed through a stuffing crimper was passed through zigzag bars in a steam chamber under the atomospheric pressure to stretch crimps of the filaments and also disentangle interfilamentary entanglements. The resulting tow of about 200 mm in width was fed between an upper circulating belt and a lower one, both having a width of 250 mm, shown in FIG. 1 and FIG. 2. The belts were advanced among three oblique bars of each 100 mm in diameter and 2,000 mm in length and having an oblique angle of 10° to the advancing direction of the belts, as shown in the figures. The tow placed between the surfaces of the two belts were drawn by pinch rolls in a perpendicular direction to the holding straight line along the oblique bars arranged obliquely to the belts, to give a filament tow of 1,100 mm in width having a nearly uniform density of about 9 g/m$^2$ at a velocity of 40 m/min.

EXAMPLE 2

Untwisted fifty ends of glass rovings of 10,000 d were warped with a comb so as to have a pitch of 5 mm and fed between an upper circulating belt and a lower one of each 300 mm in width. The web was taken as described above, using the oblique direction-turning bars having an oblique angle of 12°, to give a glass web having a width of 1,250 mm and an average density of 45 g/m$^2$, wherein rovings having a uniformly extended width of about 20 mm and a density of 55 g/m$^2$ were arranged in parallel at pitches of 25 mm, each having a gap of 5 mm.

We claim:

1. In a process for broadening the width of an advancing bundle of substantially parallel filaments by holding the bundle so as to form a holding line which is straight and oblique to the advancing direction of the bundle, turning the direction of the bundle having passed through the holding line to a direction at an optional angle against the holding line and taking up the resulting broadened bundle, the improvement which comprises (a) placing a bundle of parallel filaments as a tow between two upper and lower belts that are circulating at the same speed about spaced apart pairs of pulleys, (b) passing the bundle of parallel filaments through a press-holding line located intermediate said pairs of pulleys;

(1) which is straight and oblique to the advancing direction of the bundle, (2) which consists of one non-rotatable elongated cylindrical bar that is disposed oblique to the advancing direction of the belts, and (3) which is formed by pressing the bundle sandwiched between belts straightly and obliquely to the advancing direction of the bundle along said bar, by tension of the belts which is originated from running the belts around the bar in contact with the periphery of the bar at a definite angle, (c) after passing through the press-holding line, opening the two belts by deviating one of the belts at the holding line after passing therethrough, (d) turning the advancing direction of the bundle to a direction at an optional angle against the press-holding line; and (e) taking up the resulting bundle having the desired broadened width.

2. A process according to claim 1 wherein said upper and lower circulating belts with said bundle of parallel filaments placed therebetween are pressed from below and above by two non-rotatable parallel elongated straight cylindrical bars that are positioned obliquely to the advancing direction of the belts, the upper of said bars forming said press-holding line, and the lower of said bars serving to tension said bundle therebetween, said bars being spaced laterally of each other.

* * * * *